United States Patent [19]

Freeman

[11] 4,235,065

[45] Nov. 25, 1980

[54] METHOD OF PACKAGING FRAGILE ARTICLES

[76] Inventor: Harry Freeman, P.O. Box 347, Slatersville, R.I. 02876

[21] Appl. No.: 23,176

[22] Filed: Mar. 23, 1979

[51] Int. Cl.[3] ..... B65B 23/00; B65B 23/02; B65B 23/22

[52] U.S. Cl. ..... 53/472; 53/474; 53/475; 206/522

[58] Field of Search ..... 53/472, 403, 474, 475; 206/522

[56] References Cited

U.S. PATENT DOCUMENTS

| | | | |
|---|---|---|---|
| 3,163,286 | 12/1964 | Covington, Jr. | 53/472 X |
| 3,222,843 | 12/1965 | Schneider | 53/472 X |
| 3,398,501 | 8/1968 | Aninger | 53/472 X |
| 3,419,134 | 12/1968 | Fitts | 53/472 X |
| 3,667,593 | 6/1972 | Pendleton | 53/472 X |
| 3,817,803 | 6/1974 | Horsky | 53/403 X |
| 3,938,298 | 2/1976 | Luhman et al. | 53/403 |

FOREIGN PATENT DOCUMENTS

| | | | |
|---|---|---|---|
| 1360924 | 7/1974 | United Kingdom | 53/472 |

*Primary Examiner*—Horace M. Culver
*Attorney, Agent, or Firm*—Barlow & Barlow

[57] ABSTRACT

A box-like container receives a deflated sealed expandable tube which is disposed with one sealed end as a first layer of the tube over the inside bottom wall of the container. Fragile articles are then laid on the upper side of this first layer in a random fashion and spaced apart. A second layer of the tubing is then disposed across the fragile articles and another group of fragile articles is positioned on the second layer of tubing. The tubing is then disposed across this second group and so forth until the container is filled to the desired extent. The tube is then inflated with a gas to expand the tubing between the fragile articles and will suspend the articles between the inflated layers. A closure valve is disposed in a convenient location for the inflating and deflating of the tube.

3 Claims, 5 Drawing Figures

10
11
12
13
15
16
17
18
20
21
22
25

METHOD OF PACKAGING FRAGILE ARTICLES

BACKGROUND OF THE INVENTION

Air has been used in connection with packaging such, for example, as the partial inflation of an inner tube for an automobile, while it is being shipped in a container to prevent abrasion by movement of the inner tube in the container such as in U.S. Pat. No. 1,387,549. Air has also been used to provide a cushioning device as an entire package as in U.S. Pat. No. 2,835,596, but to applicant's knowledge, air has not been used in a tube as the cushioning medium.

SUMMARY OF THE INVENTION

An expandable gas impermeable tube which may be sealed is utilized as a separating means and also cushioning means by packing fragile articles on the tube when deflated or in a flat condition, the articles being spaced from one another and provided in layers by the folding of the tube back and forth over each layer of articles placed on the tube, and when the tube with fragile articles thereon is expanded in a container, the tube bulges up between the articles to keep them separated from each other and also provides a cushioned layer between groups of articles placed on the layers of tube which extends back and forth in the container. An air valve is utilized at a convenient location for the inflation of the tube when the container is filled to the desired extent, enabling the tube to be deflated after the container has arrived at its point of shipment for removing the articles from their packed positions.

DESCRIPTION OF THE PREFERRED EMBODIMENT

Figures 1, 2, 3, 4, 5:
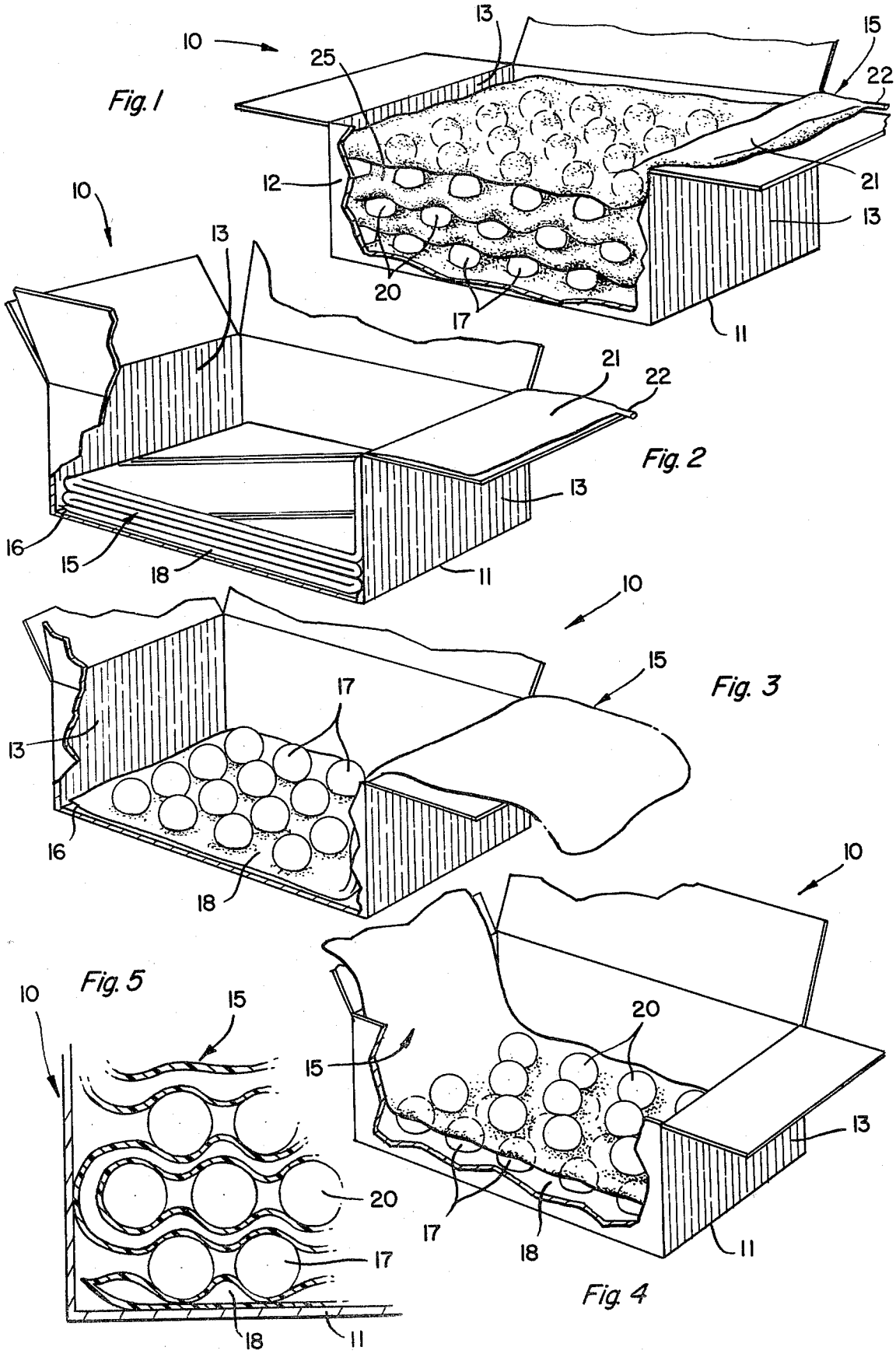
FIG. 1 is a perspective view partly broken away of a completely filled carton ready for sealing.
FIG. 2 is a similar view with the cushioning material therein.
FIG. 3 is a similar view with the cushioning material and a first layer of articles thereon.
FIG. 4 is a further similar view showing a second layer.
FIG. 5 is an enlarged fragmentary sectional view showing a completed package.

A container 10 is provided usually in a rectangular form having a bottom wall 11, side walls 12 and end walls 13. Flaps may be provided for the closure of the otherwise open top of the container 10. An inflatable, gas impermeable tube designated generally 15 is of an expandable material sealed at its opposite ends. In its deflated flat condition, it will be of a width substantially the width of the inside of the container into which it is to be positioned. As seen in FIG. 2, there will be a number of festooned layers. The tube 15 is partially withdrawn so that one sealed end 16 of the deflated tube is positioned flat along the bottom wall 11 of the container 10 in a single layer 18 (see FIG. 3). Fragile articles designated 17 are then positioned along this first layer 18 of tubing on the bottom wall. Such articles may be fruit, if desired, or any other articles which need some protection in shipping. These articles 17 are placed at random on this first layer 18 and in spaced relation to each other. While these articles are being placed on the lower layer of tubing 18, the remainder of the tubing is held out of contact with this layer and may be disposed over an end wall of the container to get it out of the way.

After the first group of articles, such as 17, are placed on the first lower layer 18, the tubing still in its deflated condition is then disposed over the articles 17 placed on the first layer a second layer 19 and then a second group of articles 20 is placed on this second layer of the tubing also in a random fashion and out of contact with each other (see FIG. 4). The second group will be placed into the spaces between the articles on the layer below by reason of the layer below bulging upwardly portions of the second layer. After the disposal of the second group of articles on the second layer, the tubing is then placed over the second group and a third layer will be positioned, and so forth, until the container is substantially filled or the desired number of articles are positioned in the container. Assuming the container is substantially filled as seen in FIG. 1, the tubing will be of such an extent that a small portion 21 will be available at the sealed end of the tubing and in this portion there will be an air valve 22, which is a type such as a bicycle tire valve, and gas, usually air, will be injected into the tube to a pressure of, for example, 0.5 to 2 p.s.i. and will cause portions of the tube such as 25 in each of the layers to project between the articles which are positioned thereon. The articles will naturally assume a staggered relation and the layers provide form fitting portions about each of the articles keeping them separated and also providing a gas suspension of one layer from the other (see FIG. 5). At the same time inasmuch as the tubing is of substantially the width of the container, the tubing will expand into engagement with the walls of the container to keep the entire mass of packed articles from moving inside the container providing a safe shipment of fragile articles from one point to another. When the container has arrived at its point of shipment, the air valve 22 may provide a means for deflation of the tubing and allow easy removal of the fragile articles from the container by a reverse of the packing arrangement which has been described above. The tube 15 can be reused by returning it in a small package in deflated form.

I claim:

1. The method of packing fragile articles utilizing a finite sized container having a bottom wall and a sealed expandable and deflatable tubing of a length greater than the longest inside dimension of the container which comprises disposing a sealed end of the deflated tubing in a first layer over the inside bottom of the container with the remainder of the tubing removed from above the first layer, placing a first group of the fragile articles to be packed on the first layer, disposing another portion of the tubing in a second layer over the fragile articles, placing a second group of fragile articles to be packed on the second layer of tubing, and so forth, until the desired quantity of articles are packed and then inflating the tube with gas to cause the tubing to separate the fragile articles and suspend the articles between the inflated layers.

2. The method of claim 1 wherein the articles are positioned at random out of contact with each other on the layers of tubing.

3. The method of claim 1 wherein the choice of the inside width of the container and the width of the tube layers is of a close enough size so that upon inflation the tube will engage the sides of the container.

* * * * *